US009082599B2

(12) United States Patent
Rafferty et al.

(10) Patent No.: US 9,082,599 B2
(45) **Date of Patent: *Jul. 14, 2015**

(54) MASS SPECTROMETER ION TRAP HAVING ASYMMETRIC END CAP APERTURES

(71) Applicant: 1st DETECT CORPORATION, Austin, TX (US)

(72) Inventors: David Rafferty, Webster, TX (US); Michael Spencer, Manvel, TX (US)

(73) Assignee: 1st Detect Corporation, Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/082,555

(22) Filed: Nov. 18, 2013

(65) Prior Publication Data

US 2014/0252224 A1 Sep. 11, 2014

Related U.S. Application Data

(63) Continuation of application No. 13/794,674, filed on Mar. 11, 2013, now Pat. No. 8,610,055.

(51) Int. Cl.

| | |
|---|---|
| ***H01J 3/00*** | (2006.01) |
| ***H01J 49/42*** | (2006.01) |
| ***H01J 49/02*** | (2006.01) |

(52) U.S. Cl.

CPC ..... *H01J 49/02* (2013.01); *H01J 49/424* (2013.01); *H01J 49/4255* (2013.01)

(58) Field of Classification Search

CPC ..... H01J 49/42; H01J 49/00; H01J 49/34; H01J 49/02; H01J 3/00; H01J 3/18; H01J 3/20; H01J 49/10; B01D 59/44

USPC ..... 250/281, 282, 292, 283, 290, 293

See application file for complete search history.

(56) References Cited

U.S. PATENT DOCUMENTS

| | | | | |
|---|---|---|---|---|
| 7,294,832 | B2 | 11/2007 | Wells et al. | |
| 7,514,674 | B2 | 4/2009 | Glish et al. | |
| 7,973,277 | B2 | 7/2011 | Rafferty | |
| 8,334,506 | B2 * | 12/2012 | Rafferty | 250/288 |
| 8,610,055 | B1 * | 12/2013 | Rafferty et al. | 250/282 |
| 2003/0150989 | A1 | 8/2003 | Yoshinari et al. | |
| 2003/0155502 | A1 | 8/2003 | Grosshans et al. | |
| 2006/0214096 | A1 | 9/2006 | Pau | |
| 2012/0223244 | A1 * | 9/2012 | Welkie | 250/396 ML |

OTHER PUBLICATIONS

International Search Report and Written Opinion dated Oct. 10, 2014 in corresponding International Application No. PCT/US2014/019079, 12 pages.

J. Franzen, Simulation study of an ion cage with superimposed multipole fields, International Journal of Mass Spectrometry and Ion Processes, v. 106 (1991), pp. 63-78.

* cited by examiner

*Primary Examiner* — Nikita Wells

(74) *Attorney, Agent, or Firm* — Finnegan, Henderson, Farabow, Garrett & Dunner LLP

(57) ABSTRACT

An ion trap for a mass spectrometer is disclosed. The ion trap includes a ring electrode and first and second electrodes which are arranged on opposite sides of the ring electrode. The ring electrode and the first and second electrodes are configured to generate an electric field based on the received RF signal. The first electrode defines a first aperture and the second electrode defines a second aperture, the first aperture and the second aperture being asymmetric relative to each other and configured to generate a hexapole field.

20 Claims, 2 Drawing Sheets

MASS SPECTROMETER ION TRAP HAVING ASYMMETRIC END CAP APERTURES

This is a continuation of application Ser. No. 13/794,674, filed Mar. 11, 2013, which is incorporated herein by reference.

FIELD OF THE DISCLOSURE

The present disclosure relates to a mass spectrometer, and more particularly, to a mass spectrometer ion trap having asymmetric end cap apertures.

BACKGROUND OF THE DISCLOSURE

Mass spectrometry is a technique used in the field of chemical analysis to detect and identify analytes of interest. Such analytes include, but are not limited to, residues and vapors from explosives, chemical warfare agents, toxic chemicals, narcotics, volatile and semi-volatile organic compounds, airborne contaminants, food and beverage contaminants, and pollution products. In use, a sample is ionized so that components may be acted on by magnetic fields, electric fields, or combinations thereof, and subsequently detected by a detector.

As chemical analysis has become a more routine part of many industries, a need has developed for smaller, lighter mass spectrometers that can be incorporated more easily into laboratory, medical, security, and industrial settings and that have lower initial instrument costs and continued operating costs. Mass spectrometers employing ion traps are more easily miniaturized than other structures such as quadrupole, time-of-flight, and sector mass spectrometers. Because of their small size, they may be used in both stationary and portable (field deployable) mass spectrometry applications.

An ion trap is a device that uses an oscillating electric field to store ions. The ion trap works by using an RF quadrupolar electric field that traps ions in two or three dimensions. A 3-D ion trap such as, for example, a cylindrical ion trap, may include a ring electrode disposed between a pair of end cap electrodes. In a cylindrical ion trap, the ring electrodes and end cap electrodes may define a cylindrical interior region.

One technique for creating ions from neutral sample molecules is called electron ionization. In this technique, an electron beam is accelerated by an electric potential, may be focused by a lens, and introduced into the trap via en aperture in an entrance end cap electrode to ionize a sample contained within the trap. Ions are then sequentially ejected from the ion trap based on their mass via an aperture in the exit end cap electrode. Ions are selectively ejected in this way by adjusting the RF electric field inside the trap in a controlled manner. A mass spectrum can then be generated by measuring the ejected ions with a detector.

In conventional cylindrical ion traps, the ejection efficiency, resolution, and/or sensitivity of the mass spectrometer may suffer due to the configuration of the trapping elements. For example, in cylindrical ion traps having RF electric fields, the ions may be trapped between symmetric end cap electrodes. When the ions are excited to perform mass-dependent ejection from the trap, the size of their orbit may increase equally toward each end cap electrode. As a consequence, some ions may be ejected via the entrance aperture, reducing the overall sensitivity of the device.

Other ions may actually miss the exit aperture. Such ions may deposit on the exit end cap and, over time, form a resistive layer around the exit aperture due to the deposited material. The resistive layer may subsequently accumulate and hold a charge that distorts the field in the trap which, in turn, may reduce instrument performance in the form of reduced sensitivity, mass range, and resolution. While many mass spectrometers are laboratory instruments with sophisticated users who have both knowledge and access to tools and cleaning agents, disassembly and cleaning may be impractical or impossible in portable mass spectrometer devices that may be deployed outside the laboratory.

Additionally, because of the symmetric configuration of conventional cylindrical ion traps and the geometric dimensions of the end cap apertures, some electrons injected into the trap hit an area of the exit end cap electrode around the exit end cap aperture. This leads to potential contamination or degradation of the exit end cap electrode, which can cause similar effects on performance.

Finally, mass spectrometers employing cylindrical ion traps may have poor spectral resolution compared to spectrometers employing other types of ion traps unless special techniques are implemented in theft design. The spectral resolution refers to the ability to differentiate spectral peaks of similar mass-to-charge ratio. The spectral resolution is typically measured as the ratio of a spectral peak's mass-to-charge value divided by the width of the peak at half its height or full-width-half-max (FWHM).

In other ion traps (e.g., hyperbolic traps) the spectral resolution may be improved by adding a hexapole field component to the ion trap. The hexapole field component may be created by, for example, changing a curvature of an inner surface of one or both of the end cap electrodes. This technique is not practical with cylindrical ion traps having flat electrodes, without adding cost and complexity to manufacturing the ion trap. Another technique for generating the hexapole field in hyperbolic traps is to vary the space between one of the end cap electrodes and the ring electrode. This technique may generate other undesirable fields within cylindrical ion traps.

The present disclosure is directed to a mass spectrometer that addresses one or more of these concerns.

SUMMARY OF THE EMBODIMENTS

The present disclosure relates to a mass spectrometer, and more particularly, to a mass spectrometer ion trap having asymmetric end cap apertures.

One embodiment of the disclosure is directed to an ion trap for a mass spectrometer. The ion trap may include a ring electrode configured to receive a radio frequency (RF) signal, and first and second electrodes which are arranged on opposite sides of the ring electrode. The ring electrode and the first and second electrodes may be configured to generate an electric field based on the received RF signal. The first electrode may define a first aperture and the second electrode may define a second aperture. The first aperture and the second aperture may be asymmetric relative to each other and configured to generate a hexapole field.

In various embodiments, the ion trap may include one or more of the following features: wherein the first aperture and the second aperture have different diameters; wherein the second aperture has a diameter that is larger than a diameter of the first aperture; wherein the second aperture is sized to reduce ion deposition on a portion of the second end cap electrode surrounding the second aperture; wherein the ring electrode and the first and second electrodes are configured to generate a quadrupole electric field; wherein the first and second electrodes are flat electrodes; wherein the ring electrode and the first and second electrodes define a cylindrical configuration; wherein a maximum diameter the second aperture is determined based on a maximum desired hexapole field; and wherein the dimensions of the second aperture relative to the first aperture are determined based on a desired hexapole field.

Another embodiment of the disclosure is directed to a mass spectrometer. The mass spectrometer may include an ion trap configured to capture ions generated when a sample is ionized by an on source. The ion trap may include a ring electrode, and first and second end cap electrodes which are arranged on opposite sides of the ring electrode. The first end cap electrode may include a first aperture through which the electrons emitted by the on source enter the ion trap, and the second end cap electrode may include a second aperture through which ions are discharged from the ion trap. The first aperture and the second aperture may have different diameters to induce a hexapole field component of an electric field inside the ion trap. The mass spectrometer may further include an on detector which detects an amount of the ions discharged from the ion trap.

In various embodiments, the mass spectrometer may include one or more of the following features: wherein the ion trap is a three-dimensional ion trap; wherein the ion trap is a cylindrical ion trap having an axially asymmetric configuration; wherein the second aperture has a larger diameter than the first aperture; wherein the first end cap electrode includes a first surface oriented towards the on source, wherein the first surface includes a recess formed around the aperture, and wherein the recess and first aperture are configured to efficiently allow an electron beam to enter ion trap; wherein the second aperture has a diameter larger than the first aperture so as to prevent electrons from the electron beam from impinging an area of the second end cap electrode surrounding the second aperture; wherein RF energy is applied to the ring electrode to generate the electric field in the ion trap, and wherein the dimensions of the first and second apertures are determined based on a desired electric field; and wherein a maximum diameter of the second aperture is determined based on a desired contribution of a hexapole field to the electric field.

Another embodiment of the disclosure is directed to a method of analyzing a sample. The method may include ionizing a sample and capturing the ions in an ion trap of a mass spectrometer. The ion trap may include a ring electrode, and first and second end cap electrodes which are arranged on opposite sides of the ring electrode. The first end cap electrode may include a first aperture, and the second end cap electrode may include a second aperture through which ions are discharged from the ion trap. The first aperture and the second aperture may be asymmetric relative to each other to generate a hexapolar field component of an electric field inside the on trap. The method may further include detecting an amount of ions discharged from the ion trap.

In various embodiments, the method may include one or more of the following features: wherein the electric field within the ion trap is a quadrupole electric field; and further including causing ions to be ejected through the second aperture relative to the first aperture.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings illustrate certain embodiments of the present disclosure, and together with the description, serve to explain principles of the present disclosure.

DETAILED DESCRIPTION OF THE EMBODIMENTS

Reference will now be made in detail to an exemplary embodiment of the present disclosure, examples of which are illustrated in the accompanying drawings. Wherever possible, the same reference numbers will be used throughout the drawings to refer to the same or like parts.

The disclosure relates generally to instruments for chemical analysis such as, for example, mass spectrometers. The term "mass spectrometer" is used broadly to refer to all components and systems that may be used to detect and identify analytes using mass-to-charge ratios. The terms "analyte," "sample," "material," "chemical," and "ions" may all be used herein to refer to a substance to be analyzed and identified. Such substances include, but are not limited to, gases, proteins, residues and vapors from explosives, chemical warfare agents, toxic chemicals, food and beverage contaminants, and pollution products.

Figure 1:
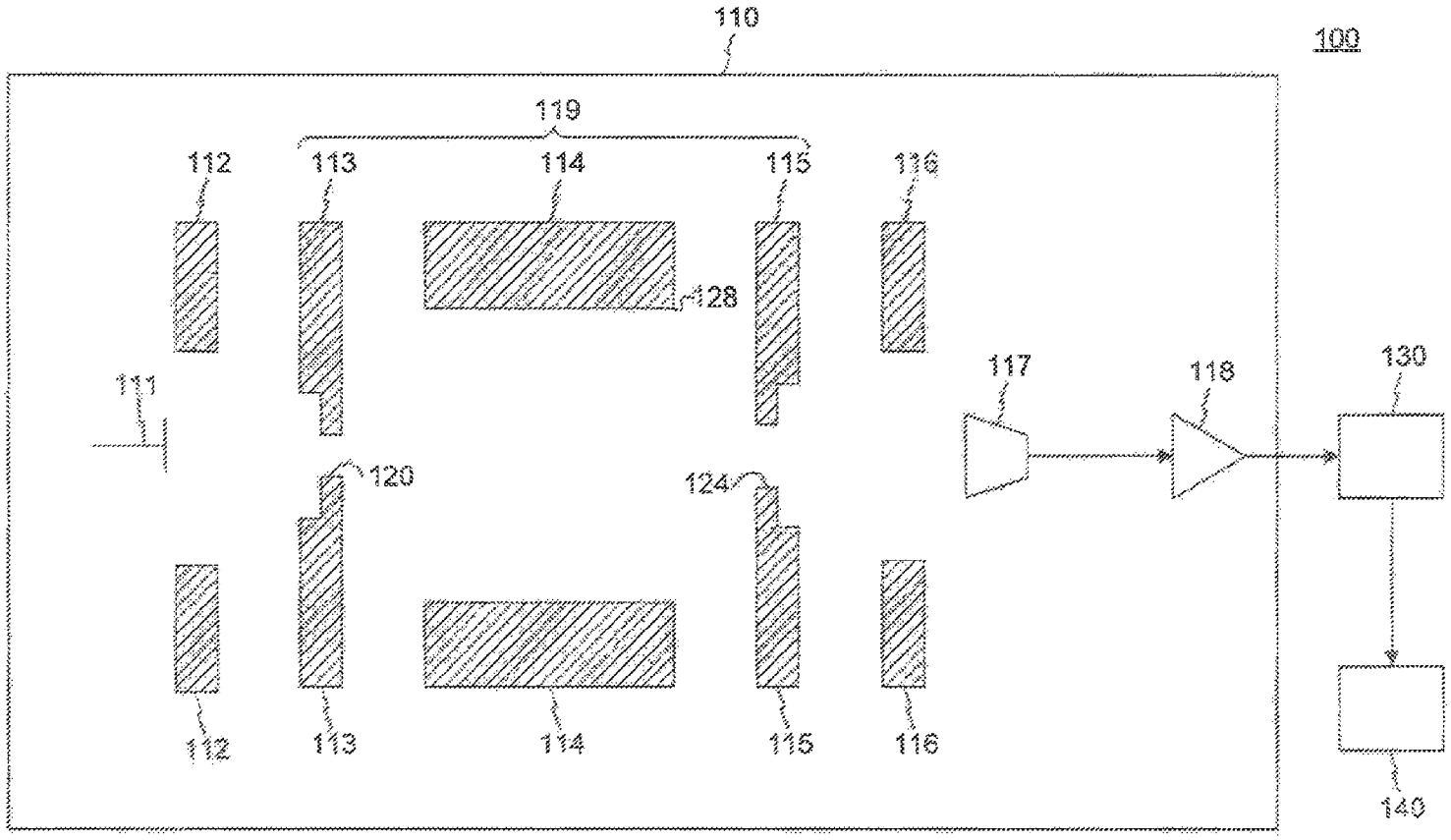
FIG. 1 is a schematic diagram of a mass spectrometer system having en ion trap.

FIG. 1 illustrates an exemplary mass spectrometer system 100 and related components. The exemplary mass spectrometer system 100 may be used in any suitable environment such as any laboratory, industrial, or commercial setting for applications including research, security, industrial process flow, and health care. Mass spectrometer system 100 may be a stationary instrument or, as in the exemplary embodiment, a portable instrument (e.g., field deployable) configured to enable in-situ analysis of a sample.

As shown in FIG. 1, components of mass spectrometer system 100 include an electron source 111, an ion trap 119, and a detector 117 housed within a chamber 110. Chamber 110 may be any suitable, substantially airtight container. Chamber 110 may be coupled to a vacuum path via one or more ports (not shown) so as to create a low pressure (e.g., vacuum) environment for chemical analysis. In operation, chamber 110 may be configured to receive a sample and convey the sample to ion trap 119 through one or more inlets (not shown). Electron source 111 may be configured to emit electrons to ionize the sample, and ion trap 119 may be configured to capture the ions and separate one or more of the ions for detection by detector 117.

In alternative embodiments, at least one of the electron source 111 and detector 117 may be positioned external to chamber 110 to reduce the area within chamber 110 and provide a compact mass spectrometer system 100. The external ionization source may be of a type and kind known to one of ordinary skill in the art. Exemplary external ionization sources include an external electro-ionization device, electro spray device, plasma device, chemical ionization device, or photo-ionization device. The external detector may also be any type and kind known well in the art. Such devices include, for example, electron multipliers.

As shown in FIG. 1, electron source 111, ion trap 119, and detector 117 are aligned along a longitudinal axis. In one embodiment, electron source 111 is positioned on a side of ion trap 119 that is opposite of detector 117. In embodiments including external ionization sources, ions may be guided into chamber 110 and ion trap 119 with lensing or ion guides. Electron source 111 may be any suitable electronic component known to one of ordinary skill in the art that emits electrons. Such devices may include, for example, filaments, cathodes, nanotube arrays, emitter arrays, and/or any other type of electron or ionization source.

In the exemplary embodiment, electron source 111 is a filament. Filament 111 may be connected to a power source (not shown). The power source may be removably coupled at an exterior location relative to chamber 110 or, alternatively, the power source may be permanently or removably coupled to chamber 110. The power source may be any suitable source of power configured to, for example, heat filament 111. As noted above, heated filament 111 may be configured to emit electrons.

A first lens 112 is disposed between electron source 111 and ion trap 119. First lens 112 may be any suitable optical component known to one of ordinary skill in the art configured to focus the electrons emitted from electron source 111 into, for example, an electron beam. First lens 112 may be composed of a single electrode or multiple electrodes having different voltages such as, for example, an Einzel lens.

First lens 112 may be configured to adjust the percentage of electrons that enter ion trap 119, and thus control the rate of ionization within the trap. In some embodiments, first lens 112 may be coupled to a controller (not shown). The controller may be configured to modulate the potential and polarity of lens 112 to change the shape of the electron beam directed at ion trap 119 and to gate the electron beam so that no new ions are generated during the ejection phase of the mass scan.

Ion trap 119 is configured to capture ions introduced within ion trap 119, and eject one or more ions for detection by detector 117. Ion trap 119 may be any suitable type of 3-D trap employing electric fields for operation. In the exemplary embodiment, ion trap 119 is a cylindrical ion trap.

As shown in FIG. 1, ion trap 119 is an assembly of multiple components including a first end cap electrode 113, a ring electrode 114, and a second end cap electrode 115. In the exemplary embodiment, first end cap electrode 113, second end cap electrode 115, and ring electrode 114 of ion trap 119 form a cylindrical configuration. It is contemplated, however, that that first and second end cap electrodes 113, 115 and ring electrode 114 may form any other shape sufficient to trap ions as part of the operation of mass spectrometer 100. In exemplary embodiments, mass spectrometer system 100 is lightweight portable unit that may, for example, have an ion trap 119 having an inner diameter in the range of 2 to 5 mm.

First and second end cap electrodes 113, 115 may include any suitable shape and/or orientation in ion trap 119. First and second electrodes 113, 115 may also include any suitable conductive material (e.g., copper, silver, gold, platinum, iridium, platinum-iridium, platinum-gold, conductive polymers, stainless steel, etc.) or combinations of conductive (and/or noble metals) materials. In the exemplary embodiment, first and second end cap electrodes 113, 115 may be flat electrodes.

First end cap electrode 113 defines a first aperture 120 through which the electrons emitted by the electron source enter ion trap 119. Second end cap electrode 115 defines a second aperture 124 through which ions are discharged from ion trap 119. As will be discussed in more detail below with reference to FIG. 2, the geometric parameters of first aperture 120 and second aperture 124 may be selected to provide increased or optimum performance with respect to mass spectrometer system 100.

Ring electrode 114 may be disposed between first end cap electrode 113 and second end cap electrode 115. For example, ring electrode 114 may be disposed half-way or centered between the first end cap electrode 113 and second end cap electrode 115. In some embodiments, the distance between the first and second end cap electrodes 113, 115 and/or the distance between each of first and second end cap electrodes 113, 115 and ring electrode 114 may be arranged so as to optimize the electric field generated within ion trap 119.

Ring electrode 114 may have any suitable shape, size and/or configuration in ion trap 119. Ring electrode 114 may also include any suitable conductive material (e.g., copper, silver, gold, platinum, iridium, platinum-iridium, platinum-gold, conductive polymers, stainless steel, etc.) or combinations of conductive (and/or noble metals) materials. In the exemplary embodiment, ring electrode 114 may be cylindrically shaped defining an opening 128 therein. Opening 128 may be aligned with first aperture 120 and second aperture 124. Although the depicted embodiment includes a single opening 128, it is contemplated that a greater or lesser number of openings may be provided in ring electrode 128.

Ion trap 119 may be configured to dynamically trap the ions in a quadrupole field within the spaced defined by first end cap electrode 113, second end cap electrode, 115, and ring electrode 114. This field may be created through application of radio-frequency (RF) and direct current (DC) voltages to ring electrode 114 relative to first and second end cap electrodes 113, 115. The voltages applied to ring electrode 114 may be altered in order to selectively destabilize different masses of ions held within ion trap 119. The destabilized ions may be ejected from the ion trap 119 via second aperture 124.

Detector 117 may be configured to detect and identify one or more ions ejected from ion trap 119, and may be of a type and kind well known in the art. Exemplary detectors include electron multipliers, Faraday cup collectors, photographic and stimulation-type detectors. Although the depicted embodiment includes a single detector 117, it is contemplated that a greater or lesser number of detectors may be provided including a detector configuration capable of detecting both positive and negative ions. Such capability may require two detectors or a detector coupled to a conversion dynode.

In some embodiments, a second lens 116 may be disposed between second end cap electrode 115 and detector 117. Second lens 116 may be any suitable optical component configured to focus the ions emitted from ion trap 119 and directed at detector 117 to improve the resolution of system 100. Second lens 119 may include a mesh, screen, or grate over the aperture to prevent high voltages from detector 117 from distorting the electric field within ion trap 119. In some embodiments, second lens 116 may not perform a lensing function, in those embodiments, second lens 116 may be configured to protect ion trap 119 from the voltages of detector 117.

Detector 117 may be configured to detect the number of ions emitted from ion trap 119 at different time intervals that correspond to particular ion masses. Detector 117 may then transmit the detected information to a processor 140. More particularly, detector 117 may be configured to output a signal to amplifier 118, which may amplify the signal generated by detector 117. Amplifier 118 may output the amplified signal to an analog-to-digital converter 130 which, in turn, may output the signal to processor 140.

Figure 2:
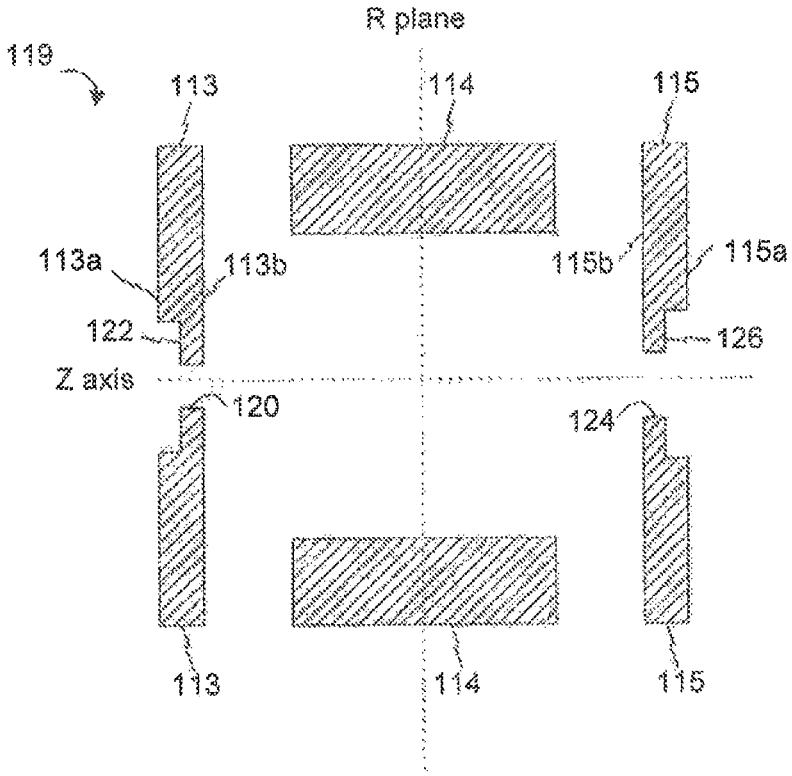
FIG. 2 is a cross-sectional view of an exemplary ion trap.

Ion trap 119 will be discussed in more detail below. As described above, conventional ion traps, including conventional cylindrical ion traps, are typically left-right symmetric (e.g., symmetric about an r-plane extending through the center of the ring electrode 114 which is perpendicular to the z-axis extending from the center of both end cap apertures). In the present disclosure, ion trap 119 has an axially asymmetric configuration about the z-axis (FIG. 2). The configuration of ion trap 119, consistent with the disclosed embodiments, may be designed so as to address one or more problems associated with the conventional symmetric, cylindrical ion traps. In particular, the exemplary ion trap 119 may be configured so as to improve ejection efficiency, to improve spectral resolution, to prevent ions from hitting the area around second aperture 124 on second end cap electrode 115, and also to prevent electrons emitted from the electron source 111 from hitting the area around the second aperture 115.

With reference to FIGS. 1 and 2, first end cap electrode 113 includes a first surface 113*a* and a second surface 113*b*. First surface 113*a* is oriented towards electron source 111 and second surface 113*b* is oriented towards ring electrode 114. First aperture 120 may be formed in a central portion of first end cap electrode 113, and extend from second surface 113*b* to first surface 113*a* First aperture 120 may be formed by any known milling or machining process. First aperture 120 may have any length, size, shape, and/or configuration. In the exemplary embodiment, first aperture 120 may have a substantially circular cross-section. First aperture 120 may be positioned centrally on first end cap electrode 113, and may be configured to be axially aligned with electron source 111.

A counter bore or counter sink 122 may be formed in first surface 113*a* about first aperture 120. Counter bore 122 may be configured to facilitate entry of the emitted electron into ion trap 119. More particularly, counter bore 112 may be configured to shape the electron beam emitted from electron source 111 and focused by first lens 112, to reduce the probability that the emitted electrons will hit the was of first end cap electrode 113, including first surface 113*a* or the walls of first aperture 120.

Second end cap electrode 115 includes a first surface 115*a* and a second surface 115*b*. First surface 115*a* is oriented towards detector 117 and second surface 115*b* is oriented towards ring electrode 114. Second aperture 124 may be formed in a central portion of second end cap electrode 115, and extend from second surface 115*b* to first surface 115*a*. Second aperture 124 may be formed by any known milling or machining process. Second aperture 124 may have any length, size, shape, and/or configuration. In the exemplary embodiment, second aperture 124 may have a substantially circular cross-section. Second aperture 124 may be positioned centrally on second end cap electrode 115, and may be configured to be axially aligned with first aperture 120 and detector 117.

A counter bore or counter sink 126 may be formed in first surface 115*a* about second aperture 124. Counter bore 126 may be configured to facilitate the ejection of ions from ion trap 119. More particularly, counter bore 112 may be provided so as to reduce the probability that the ejected ions will hit the wails of second end cap electrode 115, including the walls of second aperture 124.

In the present disclosure, first aperture 130 and second aperture 124 may have asymmetrical shapes. For example, in some embodiments, first aperture 120 and second aperture 124 may have diameters of different sizes. The diameters of first aperture 120 and second aperture 124 of ion trap 119 may be asymmetric to generate a hexapole field component between first end cap electrode 113, ring electrode 114, and second end cap electrode 115.

A hexapole field component is an odd order field that can be created in an ion trap when an asymmetry is introduced into the design. In the example embodiments, a hexapole field may have the effect of, or facilitate, causing ions to preferentially eject out one side of the ion trap more than the other. This can be used to preferentially eject ions out second aperture 124 instead of first aperture 120 to increase the sensitivity of mass spectrometer system 100.

Another effect of a hexapole field component, consistent with some of the disclosed embodiments, is the addition of hexapole nonlinear resonances. These are spots in the ion stability range having lowered stability. If an ion is stimulated at one of these spots using a resonance excitation signal applied to first and second end cap electrodes 113, 115, then the ion will eject from ion trap 119 more quickly and precisely due to the lowered stability at this spot in the stability range. When an ion is ejected more quickly from ion trap 119, this may result in better spectral resolution. A typical hexapole non-linear resonance occurs at Betaz of ⅔, or at a secular ion frequency of ⅓ of the ring electrode frequency.

The configuration of ion trap 119, consistent with the disclosed embodiments, allows for the addition of a hexapole component to cylindrical ion trap 119 without increasing the complexity of the design of first end cap electrode 113 and second end cap electrode 115. In the exemplary embodiments, the hexapole field component is generated by first aperture 120 and second aperture 124 having diameters of different sizes. More specifically, second aperture 124 may have a diameter that is larger than first aperture 120. In one preferred embodiment, second aperture 124 may have a diameter of, for example, 0.025" and first aperture 120 may have a diameter of, for example, 0.0126". In another preferred embodiment, second aperture 124 may have a diameter of, for example, 0.050" and first aperture 120 may have a diameter of, for example, 0.0126" millimeters.

In some embodiments, a finite element analysis model (FEA model) of ion trap 119 may be generated to determine a maximum and a minimum dimension (e.g., diameter) of first aperture 120 and second aperture 124. In particular, a FEA model may be generated based on a range of geometric parameters for first aperture 120 and second aperture 124. The electric field generated between the two end cap electrodes may be analyzed to determine the potential in ion trap 119 and the contribution of, for example, a hexapole field, an octopole field, and a quadrupole field to the electric field. The maximum and minimum dimensions of first aperture 120 and second aperture 124 may be determined based on, for example, the desired electric field. In some embodiments, the maximum dimension of second aperture 124 may be determined based on the desired maximum hexapole field contribution. It is contemplated that in some embodiments, the second aperture may have a diameter 1.1 to 10 times the diameter of first aperture 120 based on the desired hexapole field contribution.

With continued reference to FIGS. 1 and 2, a method for analyzing a sample will now be described. In operation, energy may be supplied to electron source 111 to energize electron source 111. In the exemplary embodiment, power may be supplied to filament 111 to heat filament 111. The hot filament 111 may then emit electrons for injection into ion trap 119. In some embodiments, the shape and/or density of the electron beam may be modulated by first lens 113. In particular, a voltage may be modulated to change characteristics such as, for example, electron density or electron focal point of the electron beam. The focused electron beam may enter ion trap 119 through first aperture 120 and ionize a sample in ion trap 119 by, for example, impact ionization.

In the present disclosure, second aperture 124 may be sized to prevent electrons from hitting the area around second aperture 124 as the electron beam is injected into ion trap 119. In particular, as the electron beam is injected into trap 119, some electrons may not impact the sample, but instead may move axially through trap 119 towards second end cap electrode 115. The geometric dimensions of second aperture 124 may reduce ion trap degradation by reducing the probability for electrons to collide with second end cap electrode 115. For example, the diameter of the second aperture 124, which is axially aligned with first aperture 120, may be sized to permit those stray electrons from the electron beam to pass through the aperture 124.

After a sample has been ionized, ions may be stored or trapped in ion trap 119 through application of radio-frequency (RF) and direct current (DC) voltages to first end cap electrode 113, ring electrode 114, and second end cap electrode 115. For example, RF voltage can be applied to ring electrode 114 while first and second end cap electrodes 113, 115 may be grounded. Ions created inside ion trap 119 from a sample may be stored or trapped in an oscillating potential created in ion trap 119 by application of the RF voltage.

The voltages may be changed so that the trapped ions are ejected from ion trap 119 towards the detector 117 in a mass-to-charge ratio dependent manner. For example, where no DC is applied and the RF amplitude is increased in a linear fashion, ions of increasing mass may be ejected from trap 119 to detector 117. In some embodiments, supplemental RF and DC fields may be applied during the RF amplitude ramp to facilitate ion ejection to detector 117. In particular, the supplemental RF and DC fields may cause a dipole axial excitation that results in resonant ejection of ions from ion trap 119 to detector 117.

The asymmetric configuration of ion trap 119 may additionally induce a hexapole field component. More specifically, the asymmetric diameters of first aperture 120 and second aperture 124 may generate a hexapole field component that may cause the ions to be ejected through second aperture 124 instead of first aperture 120. This may increase the percentage of ions that exit second aperture 124, which, in turn, may result in a higher detection efficiency.

Additionally, the size of the second aperture may reduce the probability that the ejected ions will hit the second and cap electrode 115, including second surface 115*b* and the was of second aperture 124. The configuration of second aperture 124 may also reduce ion build-up on a portion of second and cap electrode 115 surrounding the second aperture 124 which might otherwise distort the electric field within ion trap 119. This may improve the resolution and sensitivity of system 100, while also increasing its working life.

Other embodiments of the disclosure will be apparent to those skilled in the art from consideration of the specification and practice of the concepts disclosed herein. Additional benefits of the those embodiments may also apparent to those skill in the art. By way of example, where a photoionizer may be used as an ionization source, a larger second aperture may allow more light to enter trap to ionize the sample. It is intended that the specification and examples be considered as exemplary only, with a true scope and spirit of the invention being indicated by the following claims.

What is claimed is:

1. An ion trap for a mass spectrometer configured to analyze a sample, the ion trap comprising:

a center electrode configured to receive a radio frequency (RF) signal;

first and second end electrodes which are arranged on opposite sides of the center electrode, wherein the center electrode and the first and second end electrodes are configured to generate, based on the received RF signal, an electric field in an interior space defined by the center electrode, the first end electrode, and the second end electrode, and wherein the first electrode defines a first aperture to the interior space and the second electrode defines a second aperture to the interior space through which ions are preferentially ejected, wherein a diameter of the first aperture and a diameter of the second aperture are substantially asymmetric, and wherein the first electrode and the second electrode are configured to generate a hexapole field caused by the asymmetry between the first aperture and the second aperture.

2. The ion trap of claim 1, wherein the diameter of the second aperture is about twice the diameter of the first aperture.

3. The ion trap of claim 1, wherein the diameter of the second aperture is about four times the diameter of the first aperture.

4. The ion trap of claim 1, wherein the diameter of the first aperture is about 0.0126".

5. The ion trap of claim 4, wherein the diameter of the second aperture is about 0.025".

6. The ion trap of claim 4, wherein the diameter of the second aperture is about 0.050".

7. The ion trap of claim 1, wherein the dimensions of the first and second apertures are determined based on a desired electric field.

8. The ion trap of claim 7, wherein a maximum diameter of the second aperture is determined based on a maximum desired hexapole field.

9. The ion trap of claim 7, wherein a minimum diameter of the second aperture is determined based on a minimum desired hexapole field.

10. A mass spectrometer, comprising:

an ion trap configured to capture ions generated when a sample is ionized by an ion source, the ion trap comprising:

a ring electrode;

first and second end cap electrodes which are arranged on opposite sides of the ring electrode, wherein the first end cap electrode includes a first aperture, and the second end cap electrode includes a second aperture through which ions are discharged from the ion trap, wherein the second aperture has a diameter that is substantially greater than a diameter of the first aperture and sized to induce a hexapole field component of an electric field inside the ion trap; and an ion detector which detects an amount of the ions discharged from the ion trap.

11. The mass spectrometer of claim 10, wherein the diameter of the first aperture is about 0.0126 inches.

12. The mass spectrometer of claim 11, wherein the diameter of the second aperture is about 0.025 inches.

13. The mass spectrometer of claim 11, wherein the diameter of the second aperture is about 0.050 inches.

14. The mass spectrometer of claim 10, wherein the diameter of the second aperture is sized so as to substantially reduce the number of electrons from the ion source that impinge an area of the second end cap electrode surrounding the second aperture.

15. The mass spectrometer of claim 10, wherein RF energy is applied to the ring electrode to generate the electric field in the ion trap, and wherein the dimensions of the first and second apertures are determined based on a desired electric field.

16. The mass spectrometer of claim 15, wherein a maximum diameter of the second aperture is determined based on a desired contribution of a hexapole field to the electric field.

17. A method of analyzing a sample, the method comprising:

capturing ions in an ion trap of a mass spectrometer, the ion trap comprising:

a ring electrode; and first and second end cap electrodes which are arranged on opposite sides of the ring electrode, wherein the first end cap electrode includes a first aperture, and the second end cap electrode includes a second aperture through which ions are preferentially discharged from the ion trap, wherein the second aperture has a diameter that is substantially greater than a diameter of the first aperture and sized to induce a hexapole field component of an electric field inside the ion trap;

discharging ions from the ion trap through the second aperture; and detecting an amount of ions discharged from the ion trap through the second aperture.

18. The method of claim 17, applying RF energy to the ring electrode to generate an electric field in the ion trap.

19. The method of claim 18, wherein the electric field inside the ion trap is a quadrupole electric field.

20. The method of claim 17, wherein the hexapole field component causes ions to eject through the second aperture instead of the first aperture.

* * * * *